United States Patent [19]

Krenkel et al.

[11] Patent Number: 4,554,954

[45] Date of Patent: Nov. 26, 1985

[54] LOOM FOR WEAVING FLAT FABRIC

[75] Inventors: Bernhard Krenkel; Heinz Joos, both of Heidenheim, Fed. Rep. of Germany

[73] Assignee: F. Oberdorfer, Heidenheim, Fed. Rep. of Germany

[21] Appl. No.: 550,863

[22] Filed: Nov. 10, 1983

[30] Foreign Application Priority Data

Nov. 13, 1982 [DE] Fed. Rep. of Germany ..... 3242121

[51] Int. Cl.[4] ..... D03D 47/24

[52] U.S. Cl. ..... 139/439; 139/188 R

[58] Field of Search ..... 139/437, 438, 439, 28, 139/13 R, 188 R

[56] References Cited

U.S. PATENT DOCUMENTS

| | | | |
|---|---|---|---|
| 2,248,641 | 7/1941 | Moessinger | 139/188 |
| 3,378,041 | 4/1968 | Moessinger | 139/437 |
| 3,444,902 | 5/1969 | Moessinger | 139/437 |

FOREIGN PATENT DOCUMENTS

| | | | |
|---|---|---|---|
| 2406013 | 6/1979 | Fed. Rep. of Germany | 139/439 |
| 2406014 | 6/1979 | Fed. Rep. of Germany | 139/439 |
| 1158031 | 6/1969 | United Kingdom | 139/439 |

*Primary Examiner*—Henry S. Jaudon

*Attorney, Agent, or Firm*—Peter K. Kontler

[57] ABSTRACT

A loom wherein several gripper shuttles advance simultaneously along an endless path has a track with an arcuate section extending along an arc of 180 degrees ahead of the inlet to the shed. Shuttles are temporarily stored in a magazine ahead of the arcuate section and are propelled into the arcuate section and into the range of an accelerating conveyor in synchronism with movements of the reed toward and away from the fabric. The accelerating conveyor is driven by a variable-speed motor to advance a freshly engaged shuttle first at a low speed and to thereupon accelerate the shuttle to a maximum speed not later than on entry of the shuttle into the open shed. The shuttles have guide rails, guide faces and/or guide rollers which cooperate with complementary guide elements of the reed to prevent the ejection of shuttles during travel through the shed.

20 Claims, 17 Drawing Figures

LOOM FOR WEAVING FLAT FABRIC

BACKGROUND OF THE INVENTION

The present invention relates to looms in general, and more particularly to improvements in power looms of the type wherein the shuttles are caused to advance along an endless path.

Commonly owned British Pat. No. 1,158,031 discloses a loom wherein so-called gripper shuttles are caused to advance along an endless path which is defined by a track including the reed. The shuttle which is about to enter the open shed is accelerated by an endless toothed belt conveyor during travel along a relatively small portion of the arcuate section of the track preceding the reed. The conveyor is driven at an elevated speed which is deemed to be best suited for propulsion of the shuttle into the shed. The shuttle which has been accelerated to requisite speed is caused to engage the leader of the weft thread just before it enters the open shed. The weft thread is separated from the shuttle at the exit end of the shed, and the shuttle then returns into the range of the accelerating conveyor.

An advantage of a loom which employs gripper shuttles over the looms wherein the shuttles are caused to reciprocate back and forth in the region of the reed is that the gripper shuttles generate less noise. On the other hand, the speed of reciprocable shuttles at least matches the speed of gripper shuttles which are used in presently known looms wherein the gripper shuttles are caused to advance along an endless path. Moreover, the number of picks per unit of time in a loom with reciprocating shuttles is higher because a reciprocating shuttle can immediately reenter the shed as soon as it completes the advancement of weft thread in a first direction. In other words, a loom which uses reciprocable shuttles can save the time which is necessary to return a shuttle from the exit end of the shed, along the major portion of the endless path, and back into the range of the accelerating conveyor. Another drawback of presently known looms wherein the shuttles are caused to advance along an endless path is that, when the width of the woven fabric is quite pronounced and the warp threads are relatively thick, the shuttle which travels through the open shed is subjected to pronounced deceleration so that, when the width of the fabric exceeds a predetermined value and the diameter of the warp threads also exceeds a certain value, the weaving operation must be carried out in a loom which employs reciprocating shuttles. On the other hand, a loom which utilizes relatively lightweight gripper shuttles exhibits the important advantage that a lightweight shuttle constitutes a lesser danger to the attendants if it happens to be expelled from its endless path during travel through the open shed. At the same time, a presently known gripper shuttle which is caused to advance along an endless path is more likely to leave its path because the length of such shuttles is considerably less than the length of a reciprocating shuttle which carries its own supply of weft thread.

OBJECTS AND SUMMARY OF THE INVENTION

An object of the invention is to provide a novel and improved power loom which defines an endless path for the shuttles and wherein the likelihood of ejection of such shuttles from their path is much less pronounced than in heretofore known looms of such character.

Another object of the invention is to provide a loom wherein the weft thread is transported through the shed by gripper shuttles and wherein the generation of noise is much less pronounced than in heretofore known looms.

A further object of the invention is to provide a loom which can employ lightweight gripper shuttles and wherein the number of picks per unit of time is at least as high as in looms which employ reciprocating shuttles.

An additional object of the invention is to provide a loom wherein the wear upon the shuttles and upon the parts which confine the shuttles to travel along an endless path is much less pronounced than in heretofore known looms of such character.

Still another object of the invention is to provide a loom wherein the shuttles which are caused to travel along an endless path are positively held against ejection during travel through the open shed.

An additional object of the invention is to provide a novel and improved track for gripper shuttles which can be used in a loom of the above outlined character.

Another object of the invention is to provide the improved loom with novel means for accelerating successive gripper shuttles to requisite speed prior to entry into the open shed.

A further object of the invention is to provide a novel and improved power loom which can employ gripper shuttles travelling along an endless path irrespective of the width of the fabric and/or the diameters of the threads.

The invention is embodied in a loom for weaving flat fabric. The improved loom comprises a track which defines an endless path for gripper shuttles, and the track includes (a) a reed having a first side at which the shuttles enter into and a second side at which the shuttles exit from the shed and (b) an arcuate section which preferably extends along an arc of substantially 180 degrees and is disposed at the first side of the reed, a magazine which is disposed upstream of the arcuate section of the track, as considered in the direction of travel of shuttles along the endless path, a supply of shuttles in the magazine, means for delivering successive shuttles from the magazine into the arcuate section of the track, means for accelerating successive shuttles at least in the major part of the arcuate section so that the shuttles reach the first side of the reed and enter the shed while moving at a predetermined speed and thereupon return into the magazine, and cooperating first and second guide means respectively provided on the reed and on the shuttles to maintain the shuttles in the endless path during travel through the shed. The first guide means preferably extends at least substantially along the full length of the reed, as considered in the direction of travel of shuttles through the shed.

The arcuate section of the track has an inlet for reception of successive shuttles from the delivering means and an outlet which discharges successive accelerated shuttles into the shed, and the accelerating means can comprise an endless flexible conveyor (e.g., a smooth-surfaced or a toothed belt) which is trained over pulleys and includes first and second shuttle-engaging portions which are respectively adjacent to the inlet and the outlet of the arcuate section. The loom can further comprise a wheel whose radius at least approximates the radius of curvature of the arcuate section, and the conveyor then comprises a third portion which is disposed between the first and second portions and is trained in part about the wheel. The conveyor can be driven by a variable-speed drive means, preferably a means for driving the conveyor at a relatively low first speed during delivery of a shuttle from the magazine into the arcuate section of the track and at a relatively high second speed during admission of the shuttle into the shed.

The magazine can comprise means for accumulating a stack of superimposed or successive shuttles adjacent to or in the path ahead of the arcuate section of the track, as considered in the direction of travel of shuttles along such path. The delivering means can comprise a paddle wheel or other suitable means for intercepting the shuttles which arrive from the second side of the reed and the paddles of the paddle wheel can constitute means for propelling successive shuttles into the arcuate section of the track. Alternatively, the magazine can comprise an endless conveyor having projections which are movable along a portion of the endless path ahead of the arcuate section of the track.

The second guide means can comprise rails which are provided on the shuttles and are arranged to travel along the top shed during advancement of the respective shuttles through the shed. If the shuttles are elongated, the rails preferably extend in the longitudinal direction of the respective shuttles. The first guide means can comprise a second rail provided on the reed and overlying the top shed opposite the rails of successive shuttles during passage of the respective shuttles through the shed. Such second rail is preferably movable with reference to the reed toward and away from the top shed; for example, the second rail can be pivotably mounted on the reed.

Alternatively, the second guide means can comprise rotary elements on the shuttles. If the shuttles are mounted on wheels and the reed is substantially horizontal, the rotary elements preferably extend above the wheels of the respective shuttles during travel through the shed.

The first guide means can comprise a comb whose prongs extend between the warp threads, and the loom can further comprise means for moving the prongs out of the spaces between the warp threads in response to movement of the reed to beat up the picks. The combs together define a portion of the track for movement of successive shuttles therealong during travel through the shed.

The novel features which are considered as characteristic of the invention are set forth in particular in the appended claims. The improved loom, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
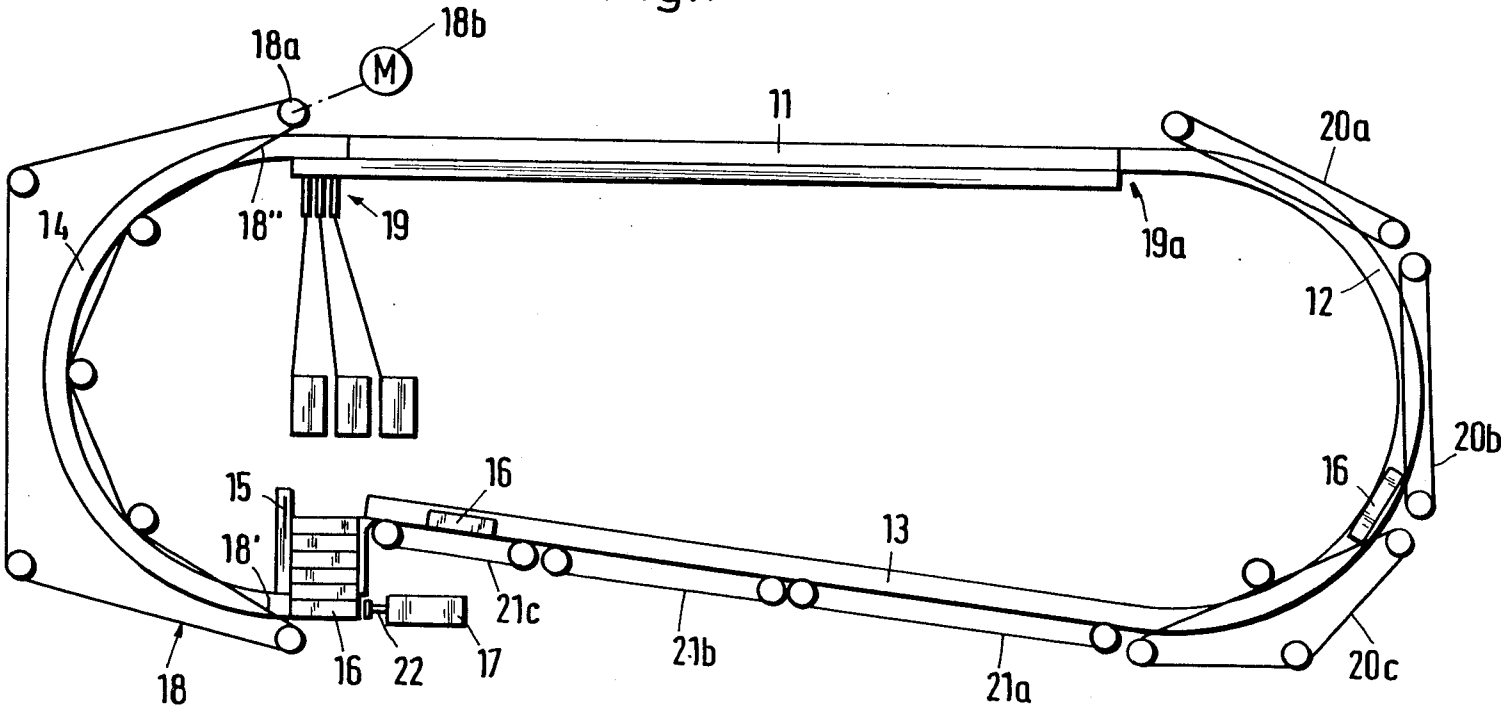
FIG. 1 is a schematic elevational view of a loom which embodies one form of the invention and comprises a magazine for a stack of superimposed gripper shuttles.

FIG. 1 illustrates only those components of a novel loom which are necessary for adequate understanding of the invention. The loom comprises a track defining an endless path for a succession of gripper shuttles 16. The track is formed in part by an elongated horizontal reed 11, a rear arcuate section 12 which extends along an arc of substantially 180 degrees starting at that (second) side of the reed 11 where the shuttles 16 leave the shed, a straight bottom or return section 13 which is disposed at a level below the reed 11, and a second arcuate section 14 which also extends along an arc of approximately 180 degrees and terminates at the other (first) side of the reed 11, namely, in the region where successive shuttles 16 enter the shed. The loom further comprises an upright magazine 15 for a supply of superimposed gripper shuttles 16. The arrangement is such that the discharge end of the bottom section 13 of the track admits successive shuttles 16 into the top part of the magazine 15 wherein the freshly admitted shuttle comes to rest on the uppermost shuttle of the stack, and that the lowermost shuttles are successively expelled from the magazine 15 into the adjacent inlet of the arcuate section 14 at preselected intervals in response to actuation of a delivering means including a fluid-operated (e.g., pneumatic) cylinder and piston unit 17 having a piston rod provided with a pusher 22 which can shift the lowermost shuttle 16 of the stack in the magazine 15 lengthwise into the inlet of the arcuate section 14. The frequency of forward strokes of the pusher 22 corresponds to the frequency of cycles of the loom.

The means for accelerating successive shuttles 16 during advancement from the inlet to the outlet of the arcuate section 14 of the track comprises an endless smooth-surfaced or toothed belt conveyor 18 which is trained over several pulleys 18*a* so that its arcuate inner reach engages a shuttle 16 which is expelled from the magazine 15 in response to a forward stroke of the pusher 22. The conveyor 18 is driven by a drive means including a variable-speed motor 18*b* whose speed is regulated in such a way that the freshly delivered shuttle 16 is advanced at a relatively low speed during travel with that portion (18') of the conveyor 18 which is located immediately downstream of the magazine 15, and that the speed of the shuttle is much higher when it advances with that portion (18'') of the conveyor 18 which is adjacent to the outlet of the section 14, i.e., which propels the fully accelerated shuttle into the shed. The conveyor 18 can also be driven at a constant (relatively high) speed if the mounting of its inner reach is such that the shuttle 16 which has been expelled from the magazine 15 undergoes gradual acceleration during travel all the way from the inlet to the outlet of the arcuate section 14 of the track. Each shuttle 16 which is about to enter the open shed is designed to engage and grip the leading end of a weft thread at a thread supplying station 19 which is adjacent to the left-hand side of the reed 11. The manner in which the accelerated shuttles 16 engage the weft threads at the station 19 and in which the shuttles 16 are separated from the weft threads at the station 19*a* downstream of the reed 11 forms no part of the invention. Reference may be had to the aforementioned commonly owned British Pat. No. 1,158,031 which shows and describes all details of the means for locating the leader of a weft thread in the path of an oncoming shuttle and of the means for detaching the weft thread from the shuttle when the latter exits from the shed.

The loom of FIG. 1 further comprises several additional endless belt conveyors 20*a*, 20*b*, 20*c* which are adjacent to the arcuate section 12 of the track and serve to transport successive shuttles 16 into that portion of the endless path which is defined by the straight bottom section 13. The purpose of the inner reaches of the conveyors 20*a*, 20*b* and 20*c* is to intercept the rapidly advancing shuttles 16 and to decelerate such shuttles in stepwise fashion or gradually to a speed which is best suited for advancement of shuttles along the path portion defined by the bottom section 13. The latter is adjacent to three additional endless belt conveyors 21*a*, 21*b*, 21*c* which advance successive shuttles 16 toward and into the magazine 15. As mentioned above, the oncoming shuttle 16 descends or comes to rest on the uppermost shuttle of the stack of shuttles in the magazine 15. The speed of the conveyor 21*c* is relatively low in order to prevent the shuttle 16, which is admitted into the magazine 15, from changing its position and/or orientation during or immediately subsequent to entry into the magazine.

The movements of the pusher 22 are synchronized with the movements of the sley, and the timing of delivery of successive shuttles 16 into the inlet of the arcuate section 14 is further dependent on the rate of acceleration of shuttles during engagement with the conveyor 18. This ensures that a properly accelerated shuttle 16 invariably enters and travels through the shed while the reed 11 is held in its rear end position away from the finished fabric. The length of intervals which are required to return successive shuttles 16 from the right-hand side of the reed 11 into the magazine 15 does not influence the frequency of cycles because the loom employs several shuttles so that the frequency of movements of the sley is very high. Moreover, the sley can remain at a standstill during a large fraction of each cycle. All this contributes to a surprisingly high number of picks. Such high number of picks is attributable in part to the provision of an accelerating means (18) which extends along the entire arcuate section 14 of the track and can accelerate successive shuttles 16 to a very high speed (it is to be noted that the pusher 22 can effect a pronounced acceleration of successive shuttles 16 during entry of such shuttles into the inlet of the section 14), and in part to the utilization of several shuttles which can enter the shed at short intervals.

A shuttle 16 which has advanced through the shed is immediately engaged and decelerated by the conveyor 20*a*, and such deceleration progresses during engagement with the conveyors 20*b*, 20*c*, 21*a*, 21*b* and 21*c* to ensure that the speed of the shuttle 16 entering the magazine 15 is best suited for proper stacking and descent into the range of the pusher 22. It will be noted that the straight portion of the endless path which is defined by the bottom section 13 of the track slopes slightly upwardly, i.e., the left-hand end of the section 13 is disposed at a level above the inlet of the arcuate section 14 to ensure that the magazine 15 can store a selected optimum number of shuttles 16. Such mode of mounting the bottom section 13 and of installing the magazine 15 has been found to contribute to compactness of the improved loom and to convenient positioning of the delivering means 17, 22 at the level of the inlet of arcuate section 14 of the track.

The pusher 22 of the delivering means 17, 22 can be said to form part of the means for accelerating the shuttles 16 to their optimum speed which should be reached when a shuttle enters the open shed. Thus, the speed of forward strokes of the pusher 22 can be readily selected in such a way that a shuttle 16 which is caused to leave the magazine 15 travels at a predetermined initial speed before it comes into engagement with the first portion 18' of the inner reach of the accelerating conveyor 18. In the embodiment of FIG. 1, the pusher 22 is caused to perform forward and return strokes by a fluid-operated motor 17. However, it is equally within the purview of the invention to employ other propelling means such as an electric motor, an electromagnet, a piston which is propelled forwardly by a compressed gas stored in a suitable reservoir, a piston which is propelled forwardly as a result of dissipation of energy by one or more springs and/or others. The thus accelerated shuttle 16 then begins to advance with the inner reach of the conveyor 18 and ceases to slip with reference to this conveyor not later than immediately upstream of the inlet to the open shed. As mentioned above, the variable-speed motor 18*b* can drive the conveyor 18 at a lesser speed when the pusher 22 performs a forward stroke and the motor 18*b* thereupon accelerates the conveyor 18 to the maximum speed, namely, to the speed at which a fully accelerated shuttle is to enter the shed. The initial speed of the conveyor 18 can match the speed of the shuttle 16 which is propelled by the pusher 22, and the maximum speed of the conveyor 18 can be well in excess of 20 meters per second. The motor 18*b*, or a suitable braking system, immediately decelerates the conveyor 18 to the minimum speed (of forward movement of the pusher 22) to ensure that the conveyor 18 is ready to engage the next shuttle 16 coming from the lowermost portion of the magazine 15. In other words, the speed of the conveyor 18 can pulsate between a maximum speed and a minimum speed, and the regulation of the speed of the motor 18*b* can be initiated by signals which are generated by one or more sensors (not specifically shown) adjacent to the path of movement of shuttles along the arcuate section 14 of the track. Each such sensor can comprise a proximity detector or any other suitable means which is capable of generating signals denoting the speed of a shuttle which happens to advance therealong. It is also possible to employ one or more sensors which ascertain the speed of forward movement of the pusher 22 and transmit appropriate signals to the control circuit of the motor 18*b*. As mentioned above, the operation of the motor 17 is synchronized with the operation of means for moving the reed 11 to thus ensure that a shuttle which has been accelerated by the conveyor 18 will invariably enter an open shed. As also mentioned above, the exact timing of actuation of the motor 17, to effect a forward stroke of the pusher 22, is further dependent on the interval of time which is required to advance a shuttle along the arcuate section 14 of the track. For example, a fresh shuttle 16 can be propelled into the inlet of the section 14 as soon as the reed completes the beating up of the pick. This provides ample time to ensure that the shuttle is properly accelerated while the reed moves back to its rear end position in a direction away from the fabric.

Figure 2:
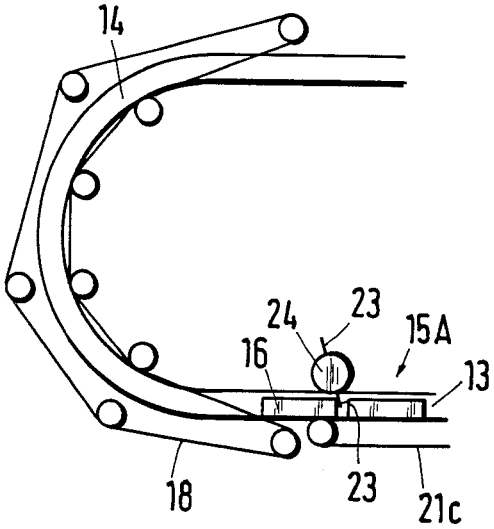
FIG. 2 is a fragmentary elevational view of a loom which comprises a modified magazine for gripper shuttles and wherein the means for delivering shuttles into the arcuate section of the track comprises a paddle wheel which is about to propel the foremost shuttle into the range of the accelerating means.
Figure 3:
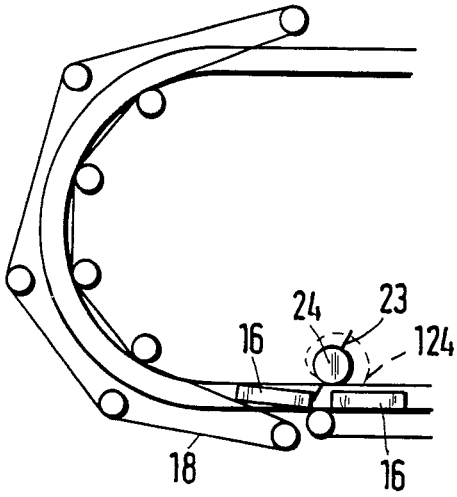
FIG. 3 illustrates the structure of FIG. 2, with the paddle wheel in the process of transferring the foremost shuttle into the range of the accelerating means.

FIGS. 2 and 3 show a portion of a modified loom wherein the discharge end of the bottom section 13 of the track is disposed at the level of the inlet of the arcuate section 14. The magazine 15A can be said to form part of the track and is defined in part by the conveyor 21*c*. The means for delivering successive shuttles 16 into the range of the endless accelerating conveyor 18 comprises a paddle wheel whose shaft 24 is indexed in synchronism with movements of the reed and by taking into consideration the interval of time which is required to accelerate a shuttle 16 during travel from the inlet of the section 14 into the shed. The paddles or vanes 23 of the shaft 24 serve as a means for intercepting the foremost shuttle 16 in the magazine 15A as well as a means for propelling successive shuttles into engagement with the accelerating conveyor 18.

FIG. 3 shows a shuttle 16 in the process of advancing into positive engagement with the adjacent first portion of the inner reach of the accelerating conveyor 18. The means for indexing the shaft 24 at predetermined intervals and in synchronism with movements of the reed can comprise a suitable energy storing device, e.g., a torsion spring 124 which is shown schematically by broken lines. In all other respects, the loom which embodies the structure of FIGS. 2 and 3 is or can be identical with the loom of FIG. 1.

Figure 4:
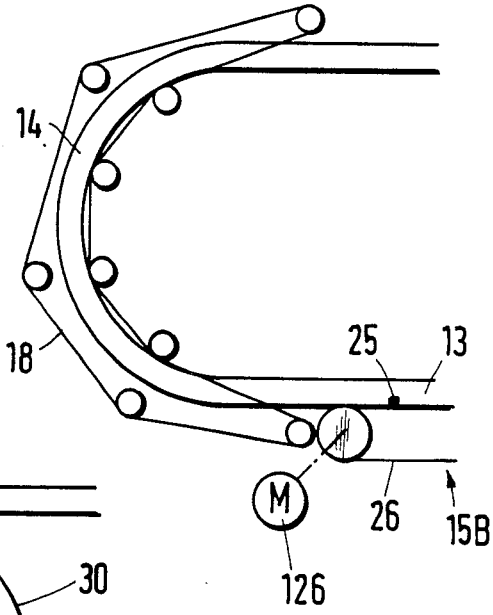
FIG. 4 is a similar fragmentary elevational view of a third loom wherein the means for delivering shuttles into the range of the accelerating means comprises one or more projections on an endless conveyor.

FIG. 4 shows a portion of a third loom wherein the magazine 15B is defined in part by the bottom section 13 of the track and the means for delivering successive shuttles into the range of the accelerating conveyor 18 comprises one or more projections 25 on an endless belt conveyor 26 corresponding to or replacing the conveyor 21*c* of FIG. 1. The drive means 126 for the conveyor 26 is operated in such a way that the forward movements of successive projections 25 are synchronized with movements of the reed, again by taking into consideration the length of intervals which are required to accelerate a shuttle 16 during travel along the arcuate section 14 of the track so that the fully accelerated shuttle invariably enters an open shed.

Figure 5:
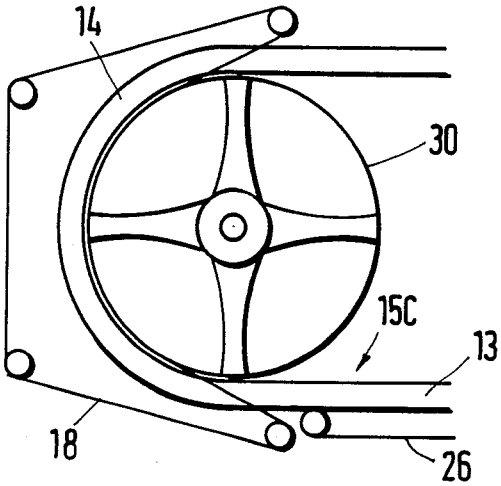
FIG. 5 is a fragmentary elevational view of a fourth loom wherein the conveyor of the accelerating means is trained in part about a wheel which is adjacent to the arcuate section of the track.

FIG. 5 shows a portion of a further loom wherein the arcuate section 14 of the track surrounds a portion of a wheel 30 whose radius preferably equals or approximates the radius of curvature of the section 14. The inner reach of the accelerating conveyor 18 is trained in part over the wheel 30 when such inner reach does not engage a shuttle. The loom of FIG. 5 is especially suited for use with shuttles which slide through the shed, i.e., for shuttles which are not or need not be provided with wheels. The magazine 15C is defined in part by the bottom section 13 of the track and in part by the conveyor 26, and the latter is designed to deliver successive shuttles into the range of the conveyor 18 at predetermined intervals as described above in connection with FIG. 1, FIGS. 2–3 and FIG. 4. When a shuttle is engaged by the inner reach of the conveyor 18, it travels along the periphery of the wheel 30 on its way toward the reed. The peripheral speed of the wheel 30 matches the speed of the conveyor 18. The peripheral surface of the wheel 30 cooperates with the inner reach of the conveyor 18 to propel the fully accelerated shuttle into the open shed.

The improved loom further comprises guide means for ensuring that the shuttles cannot leave the shed during travel in the longitudinal direction of the reed, i.e., from the outlet of the arcuate section 14 toward the inlet of the arcuate section 12 of the track. The provision of such guide means is desirable and advantageous in view of the very high speed of shuttles which leave the section 14. The guide means comprise first guide means which is provided on and preferably extends along the full length of the reed, and second guide means which is provided on each of the shuttles. Such cooperating first and second guide means not only prevent injury to attendants but also ensure predictable and substantially noiseless travel of shuttles through the open shed. FIGS. 6 to 16 illustrate various embodiments of first and second guide means which are constructed and assembled and cooperate in accordance with several features of the present invention.

Figure 6:
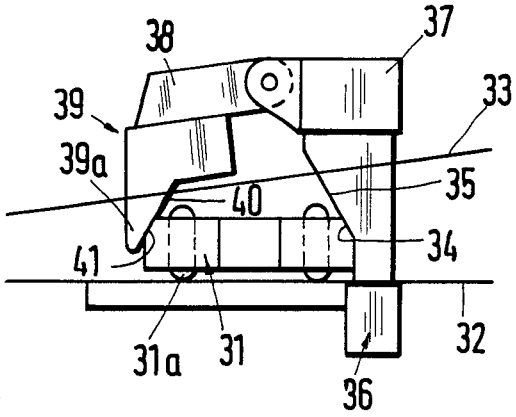
FIG. 6 is an enlarged end elevational view of the reed and of a wheel-mounted shuttle, further showing a first embodiment of cooperating first and second guide means which are respectively provided on the reed and on the shuttle and serve to retain the shuttle in the endless path during travel through the shed.

Referring first to FIG. 6, there is shown a reed 36. The top shed is shown at 33 and the bottom shed is shown at 32. A shuttle 31 is mounted on wheels 31*a* and is in the process of advancing through the shed at a high speed. The first guide means comprises a first inclined guide face 35 on the reed 36 and a second inclined guide face 40 on a comb 39 which is mounted on a carrier 38 pivotally secured to the top rail 37 of the reed 36. The second guide means comprises a first inclined guide face 34 which is provided on the shuttle 31 and is complementary to the guide face 35, and a second inclined guide face 41 which is also provided on the shuttle 31 and is complementary to the guide face 40. It will be readily appreciated that the shuttle 31 remains in the respective portion of its endless path when the carrier 38 assumes the position of FIG. 6 so that the guide face 40 engages or is closely adjacent to the guide face 41 and ensures that the guide face 34 bears against or is closely adjacent to the guide face 35. The manner in which the reed 36 is mounted on the sley (not shown) is conventional and is not illustrated in the drawing. The prongs 39*a* of the comb 39 extend into the spaces between the warp threads of the top shed 33 when the reed 36 is held in the illustrated rear end position in which the shed is open to allow the shuttle 31 to advance therethrough. The guide face 40 is a composite guide face which is defined by the prongs 39*a* of the comb 39. The distance between the guide faces 35, 40 is sufficient to enable the shuttle 31 to travel, at a high speed, at right angles to the plane of FIG. 6, with a minimum of play. At the same time, the shuttle 31 is positively held against escape or expulsion from that portion of its endless path which is defined by the reed 36 and its comb 39. When the reed 36 is moved forwardly to beat up the pick, the comb 39 is lifted above and away from the top shed 33, for example, by means of a suitable cam such as the cam 84 shown in FIG. 17. The latter pivots the carrier 38 with reference to the top rail 37 in a clockwise direction, as viewed in FIG. 6, when the reed 36 advances in a direction to the left, namely, toward the finished fabric.

Figure 7:
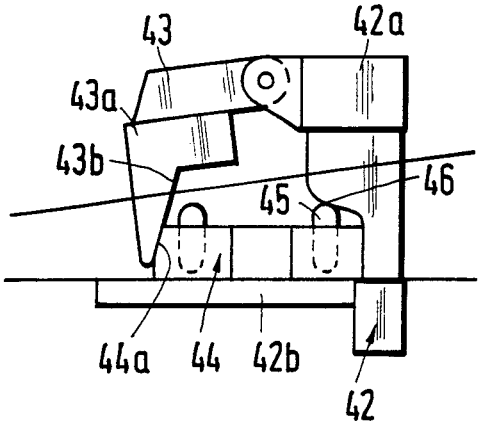
FIG. 7 is a similar end elevational view but showing a modified shuttle and a second embodiment of the first and second guide means.

FIG. 7 shows a reed 42 whose top rail 42*a* supports a pivotable carrier 43 for a comb 43*a* having prongs extending into the spaces between the warp threads when the reed is held in the illustrated rear end position. The shuttle 44 is not mounted on wheels and slides along the grooved base or bottom rail 42*b* of the reed 42. The first guide means comprises an inclined guide face 46 on the reed 42 and an inclined guide face 43*b* on the prongs of the comb 43*a*. The second guide means comprises a rotary element 45 which is provided on the shuttle 44 and rolls along the guide face 46, and a guide face 44*a* which is provided on the shuttle 44 and slides along or is closely adjacent to the guide face 43*b*. The shuttle 44 has two rotary elements 45 so that it can travel through the shed in the illustrated orientation or after turning through 180 degrees.

Figure 8:
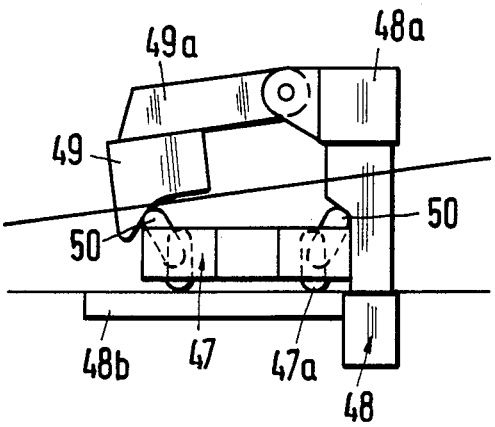
FIG. 8 is a similar end elevational view but showing a different shuttle and a third embodiment of the first and second guide means.

FIG. 8 shows a reed 48 whose bottom rail 48*b* is grooved for the warp threads and whose top rail 48*a* supports a pivotable carrier 49*a* for a comb 49. The first guide means comprises two suitably inclined guide faces, one on the reed 48 and the other on the prongs of the comb 49. The second guide means comprises two rotary elements 50 on the wheel-mounted shuttle 47. The elements 50 roll along the respective guide faces during travel of the shuttle 47 through the open shed. The axes of the rotary elements 50 are inclined with reference to the axes of the wheels 47*a*. An advantage of the structure which is shown in FIG. 8 is that the friction between the shuttle 47 on the one hand and the reed 48 and comb 49 on the other hand is minimal.

Figure 9:
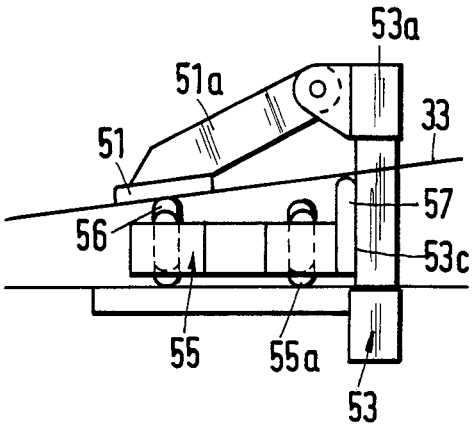
FIG. 9 is a similar end elevational view but showing a further shuttle and a fourth embodiment of the first and second guide means.

Referring to FIG. 9, the reed 53 has a top rail 53*a* which supports a pivotable carrier 51*a* for an elongated guide rail 51 engaging the upper side of the top shed 33 when the shed is open so that the wheel-mounted shuttle 55 can pass therethrough. In addition to the rail 51, the first guide means comprises an upright guide face 53*c* of the reed 53. The second guide means comprises a rotary element 56 which is mounted on the shuttle 55 so that it extends to a level above the wheels 55*a* and rolls along the underside of the rail 51. The second guide means further comprises an elongated rail 57 which is provided on and extends lengthwise of the shuttle 55 and cooperates with the guide face 53*c*. It will be noted that the rail 51 replaces the combs which are shown in FIGS. 6 to 8 and that this rail need not extend to a level below the top shed 33. Therefore, pivotal mounting of the carrier 51*a* on the top rail 53*a* of the reed 53 is optional, especially if the inclination of the top shed 33 in the rear end position of the reed 53 is rather pronounced. It is important to ensure that the guide rail 51 will not strike against and damage or otherwise affect the finished fabric when the reed 53 is moved forwardly to beat up the pick. The upper edge face of the guide rail 57 extends close to or into actual contact with the warp threads of the top shed 33.

Figure 10:
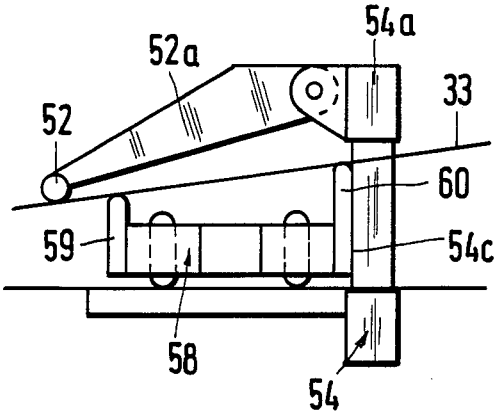
FIG. 10 is a similar end elevational view but showing an additional shuttle and a fifth embodiment of the first and second guide means.

The structure of FIG. 10 constitutes a modification of the structure which is shown in FIG. 9. The rail 51 of FIG. 9 is replaced with an elongated guide rod 52 which engages the upper side of the top shed 33 and urges the top shed against a guide rail 59 at the respective side of the wheel-mounted shuttle 58. The other side of the shuttle 58 is provided with a guide rail 60 which corresponds to the guide rail 57 of the shuttle 55 and slides along a guide face 54*c* of the reed 54. An advantage of the structure of FIG. 10 is its simplicity; however, it cannot prevent or limit lateral movements of the shuttle 58 (in a direction to the left, as viewed in FIG. 10) with the same degree of reliability as the structures which are shown in FIGS. 6 to 9. This is due to the fact that the left-hand guide rail 59 of the second guide means does not bear against the rod 52 on the carrier 52*a*. The latter can be rigidly secured to the top rail 54*a* of the reed 54 if the position of the rod 52 is such that it does not engage the finished fabric when the reed 54 is moved forwardly to beat up the pick.

Figure 11:
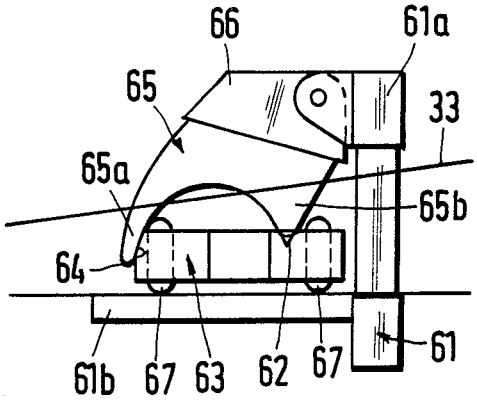
FIG. 11 is a similar end elevational view but showing a modified shuttle and a sixth embodiment of first and second guide means.

FIG. 11 illustrates a modification of the structures which are shown in FIGS. 6 to 8. The reed 61 has a top rail 61*a* for a pivotable carrier 66 which supports a comb 65. The prongs 65*a* of the comb 65 extend into the spaces between the warp threads of the top shed 33 and together define a concave first guide face 64 adjacent to a complementary convex guide face on the shuttle 63. The top portion of the shuttle 63 has a longitudinally extending triangular groove 62 for adjacent portions 65*b* of the prongs 65*a*. The convex guide face and the surfaces bounding the groove 62 of the shuttle 63 constitute the second guide means. The wheels 67 of the shuttle 63 roll along the grooved bottom rail 61*b* of the reed 61. It will be noted that the shuttle 63 need not contact the portion of the reed 61 below the top rail 61*a*.

Figure 12:
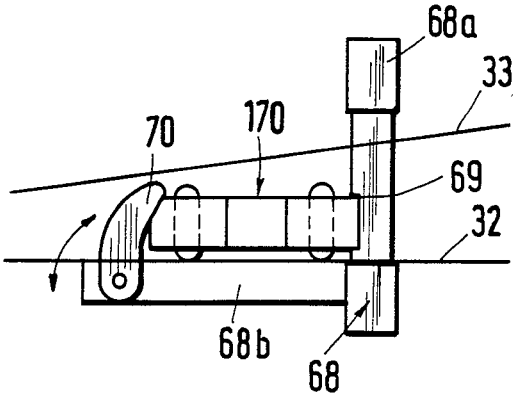
FIG. 12 is a similar end elevational view but showing a different shuttle and a seventh embodiment of first and second guide means.

FIG. 12 illustrates a reed 68 whose top rail 68*a* is located above the top shed 33 and which has a bottom rail or base 68*b* with grooves for the warp threads. The bottom rail 68*a* carries a comb 70 whose prongs can be pivoted into the spaces between the warp threads of the bottom shed 32 and have concave guide faces engaging the adjacent convex guide face of the wheel-mounted shuttle 170. The right-hand marginal portion of the shuttle 170 extends into a complementary guide groove 69 of the reed 68. The illustrated wheel-mounted shuttle 170 can be replaced with a slidable shuttle of the type shown, for example, in FIG. 7.

Figure 13:
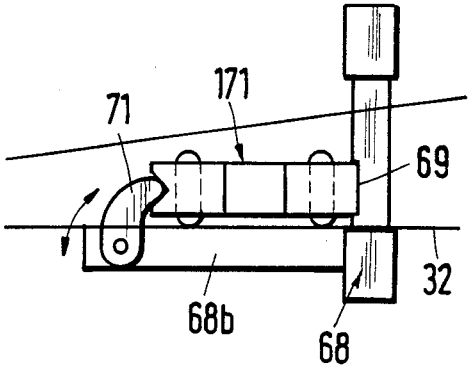
FIG. 13 illustrates a first modification of the structure which is shown in FIG. 12.

FIG. 13 shows the reed 68 of FIG. 12 in engagement with a modified shuttle 171 whose left-hand side has a triangular guide groove for the tips of prongs forming part of a comb 71 which is pivotally mounted on the bottom rail 68*b* and is pivotable out of the way (below the bottom shed 32) when the reed 68 is advanced to beat up the pick. The right-hand side of the shuttle 171 forms part of the second guide means and cooperates with the surface bounding the guide groove 69 of the reed 68.

Figure 14:
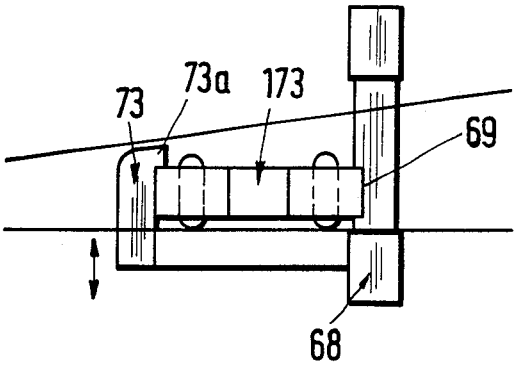
FIG. 14 illustrates a second modification of the structure which is shown in FIG. 12.

The reed 68 of FIG. 14 supports a vertically reciprocable comb 73 which is movable between the illustrated upper end position and a lower end position in which it does not interfere with forward movement of the reed. The prongs of the comb 73 have pallets 73*a* forming part of the first guide means and overlying the upper side of a shuttle 173 while the latter travels through the open shed. The first guide means further includes the surface bounding the guide groove 69 of the reed 68.

Figure 15:
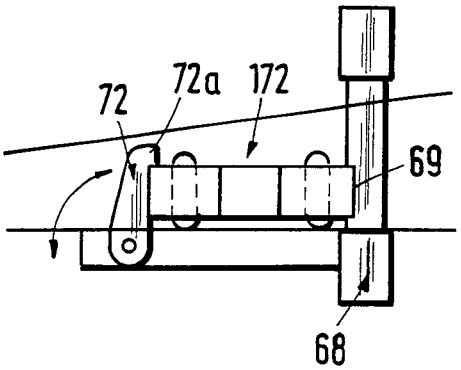
FIG. 15 illustrates a third modification of the structure which is shown in FIG. 12.

FIG. 15 shows a modification of the structure which is illustrated in FIG. 14. The vertically reciprocable comb 73 is replaced with a pivotable comb 72 having prongs whose pallets 72*a* can overlie the adjacent portion of the upper side of the shuttle 172.

Figure 16:
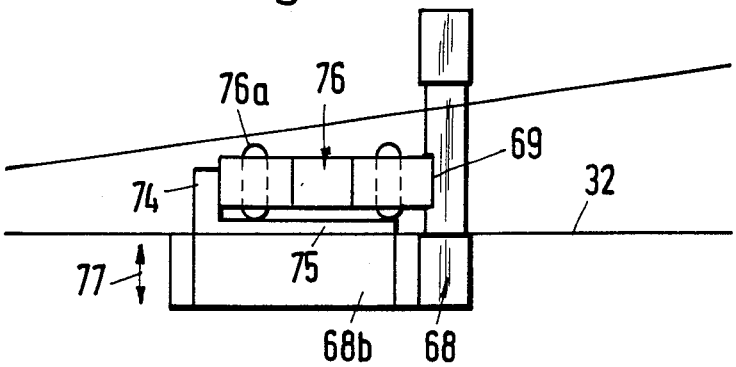
FIG. 16 illustrates a fourth modification of the structure which is shown in FIG. 12.

Referring to FIG. 16, there is shown a reed 68 which is similar to the reeds of FIGS. 12 to 15 and whose grooved bottom rail 68*b* supports a vertically movable comb 74 having prongs which define a vertical guide face for the respective side of the shuttle 76. The wheels 76*a* of the shuttle 76 roll along the upper side or surface 75 of the bottom rail 68*b*. The warp threads of the bottom shed 32 extend into the grooves which are machined into the surface 75. The depth of grooves in the surface 75 is sufficient to ensure that the rolling movement of wheels 76*a* is not affected by the diameters of the warp threads. That portion of the bottom rail 68*b* which defines the surface 75 is movable downwardly with the comb 74 in response to leftward movement of the reed 68 in order to beat up the pick. The directions of movement of the just mentioned portion of the bottom rail 68*b* and of the comb 74 between their illustrated upper end positions and the lower end positions are indicated by the double-headed arrow 77.

Figure 17:
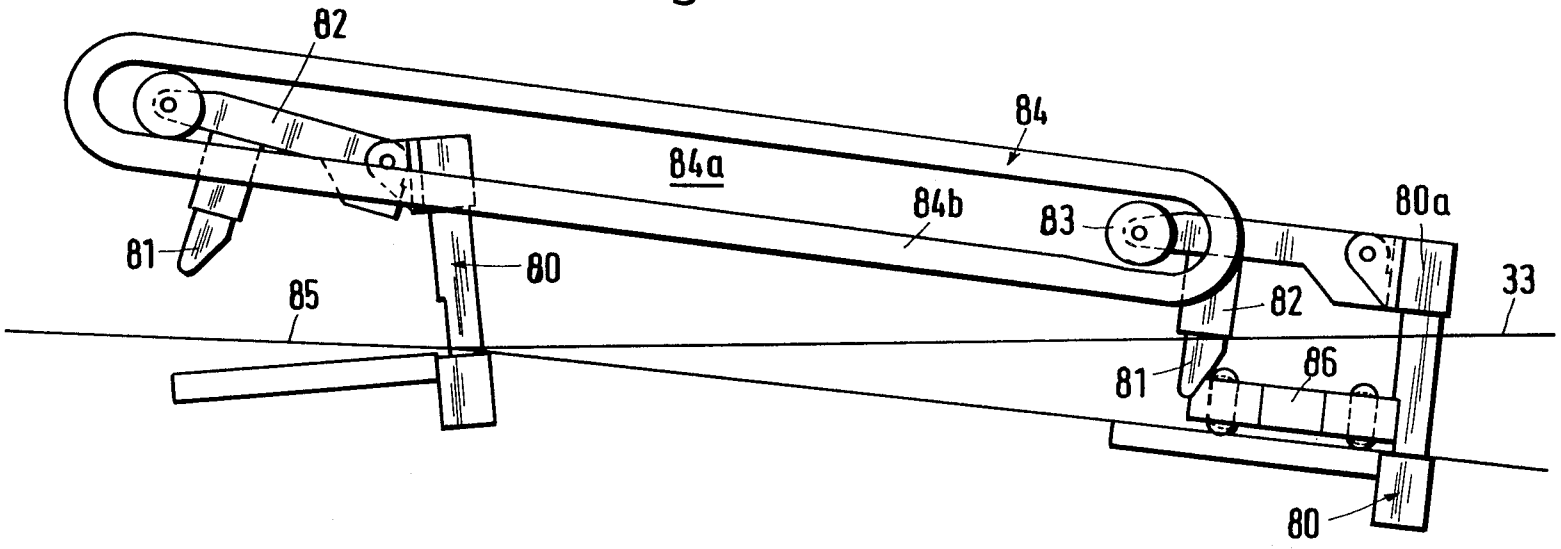
FIG. 17 is an end elevational view of a reed which is similar to the reeds of FIGS. 6 to 11 and further showing a device which lifts the prongs of a comb-shaped guide on the reed above the top shed in response to movement of the reed to beat up the picks, the reed being shown in two different positions.

Referring finally to FIG. 17, there is shown a device which can automatically pivot the comb 81 on a reed 80 when the latter advances from the right-hand (rear) end position to the left-hand end position in order to beat up the pick. The device for pivoting the carrier 82 for the comb 81 with reference to the top rail 80*a* of the reed 80 comprises a roller follower 83 which is mounted on an arm of the carrier 82 and an elongated cam 84 having a groove or slot 84*a* for the roller follower 83. The inclination of the surface 84*b* in the slot 84*a* is such that the roller follower 83 lifts the comb 81 above the top shed 33 when the reed 80 moves to the left-hand end position of FIG. 17. The finished woven fabric is shown at 85; it will be noted that the comb 81 is located at a level well above the fabric 85 when the reed 80 is in the process of beating up the pick. The comb 81 assumes the operative position which is shown in the right-hand portion of FIG. 17 when the reed 80 is returned to its rear end position. The comb 81 then cooperates with the reed 80 to guide a wheel-mounted shuttle 86 during travel of the latter through the open shed.

The structure of FIG. 17 constitutes but one form of the means which can be used to move the comb 81 between the operative and inoperative positions. For example, the carrier 82 can be rigidly secured to the top rail 80*a* if the roller follower 83 is mounted on the comb 81 and the latter is movable up and down with reference to the carrier.

An important advantage of the improved loom is that the shuttles can be accelerated to a speed well in excess of the speed that can be reached by gripper shuttles in heretofore known looms defining an endless path for the shuttles. This is attributable to considerable length of the accelerating conveyor 18 which accelerates a freshly delivered shuttle along the entire or nearly entire arcuate section 14, i.e., along an arc which equals or approximates 180 degrees. It has been found that the improved accelerating means can raise the speed of successive gripper shuttles well above 20 meters per second which was considered the maximum permissible or achievable speed of shuttles in conventional looms with shuttles advancing along an endless path. Moreover, and since the shuttles remain in longer-lasting contact with the conveyor 18 or an analogous accelerating conveyor, they are much more likely to be accelerated to an optimum speed, namely, to a speed which is most satisfactory for transport of weft threads through the open shed and for advancement of shuttles into the range of decelerating means at the exit side of the shed. This is due to the fact that, as a result of longer-lasting contact between the conveyor 18 and the shuttle which is about to enter the shed, the likelihood of slippage of an accelerated shuttle with reference to the accelerating conveyor, at least during the last stage of movement toward the reed, is practically nil:

Another advantage of the improved loom is that two or more shuttles can simultaneously advance along the endless path. This renders it possible to prolong the intervals of idleness of the reed during each cycle of the machine at the expense of the intervals which are needed to beat up the picks. This, in turn, renders it possible to provide adequate time for the passage of shuttles through the open shed even if the speed of such shuttles is not excessive. Thus, a freshly accelerated shuttle can enter the shed while one or more preceding shuttles are on their way from the reed back to the magazine. This contributes to a significant increase of picks per unit of time.

A further advantage of the improved loom is that the shuttles are positively guided during travel through the shed. This not only reduces noise but also contributes to safety of attendants and practically eliminates the likelihood that the shuttles could damage the threads.

The woven fabric 85 can be used with advantage for the making of screens, felts and like parts of paper making machines as well as for many other purposes.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a loom for weaving flat fabric, the combination of a track defining an endless path for gripper shuttles, said track including a reed having a first side for entry of shuttles into and a second side for exit of shuttles from the shed and said track further including an arcuate section at the first side of said reed; a magazine disposed upstream of said arcuate section, as considered in the direction of travel of shuttles along said path, said magazine including means for accumulating a stack of shuttles adjacent to said path ahead of said arcuate section, as considered in said direction; a supply of shuttles in said magazine; means for delivering successive shuttles from said magazine into said arcuate section; means for accelerating successive shuttles at least in the major part of said arcuate section so that the shuttles reach the first side of said reed and enter the shed while moving at a predetermined speed and thereupon return into said magazine; and cooperating first and second guide means respectively provided on said reed and on said shuttles to maintain the shuttles in said path during travel through the shed.

2. The combination of claim 1, wherein said section extends along an arc of substantially 180 degrees.

3. The combination of claim 1, wherein said reed is elongated, as considered in said direction, and said first guide means extends at least substantially along the full length of said reed.

4. The combination of claim 1, wherein said arcuate section has an inlet for reception of successive shuttles and an outlet which discharges successive accelerated shuttles into the shed, said accelerating means comprising an endless flexible conveyor and pulleys for said conveyor, said conveyor having first and second shuttle-engaging portions which are respectively adjacent to the inlet and the outlet of said arcuate section.

5. The combination of claim 4, further comprising a wheel having a radius at least approximating the radius of curvature of said arcuate section, said conveyor having a third portion disposed between said first and second portions and being trained in part about said wheel.

6. The combination of claim 1, further comprising variable-speed drive means for said conveyor.

7. The combination of claim 6, wherein said drive means includes means for driving said conveyor at a relatively low first speed during delivery of a shuttle from said magazine into said arcuate section and at a relatively high second speed during admission of the shuttle into the shed.

8. The combination of claim 1, wherein said delivering means comprises means for intercepting the shuttles arriving from the second side of said reed.

9. The combination of claim 8, wherein said intercepting means includes means for propelling successive shuttles into the arcuate section of said track.

10. The combination of claim 1, wherein said magazine comprises an endless conveyor having projections movable along said path ahead of the arcuate section of said track.

11. The combination of claim 1, wherein said second guide means comprises rails provided on said shuttles and arranged to travel along the top shed during travel of the respective shuttles through the shed.

12. The combination of claim 11, wherein said shuttles are elongated and said rails extend in the longitudinal direction of the respective shuttles.

13. The combination of claim 11, wherein said first guide means comprises a second rail provided on said reed and overlying the top shed opposite the rails of successive shuttles during passage of the respective shuttles through the shed.

14. The combination of claim 1, wherein said second guide means comprises rotary elements provided on said shuttles.

15. The combination of claim 14, wherein said reed is substantially horizontal and said shuttles comprise wheels, said rotary elements extending upwardly beyond the wheels of the respective shuttles.

16. In a loom for weaving flat fabric, the combination of a track defining an endless path for gripper shuttles, said track including a reed having a first side for entry of shuttles into and a second side for exit of shuttles from the shed and said track further including an arcuate section at the first side of said reed; a magazine disposed upstream of said arcuate section, as considered in the direction of travel of shuttles along said path; a supply of shuttles in said magazine; means for delivering successive shuttles from said magazine into said arcuate section; means for accelerating successive shuttles at least in the major part of said arcuate section so that the shuttles reach the first side of said reed and enter the shed while moving at a predetermined speed and thereupon return into said magazine; and cooperating first and second guide means respectively provided on said reed and on said shuttles to maintain the shuttles in said path during travel through the shed, said second guide means comprising rails provided on said shuttles and arranged to travel along the top shed during travel of the respective shuttles through the shed, said first guide means comprising a second rail provided on said reed and overlying the top shed opposite the rails of successive shuttles during passage of the respective shuttles through the shed, said second rail being movable with reference to said reed toward and away from the top shed.

17. The combination of claim 16, wherein said second rail is pivotably mounted on said reed.

18. In a loom for weaving flat fabric, the combination of a track defining an endless path for gripper shuttles, said track including a reed having a first side for entry of shuttles into and a second side for exit of shuttles from the shed, said reed being movable to beat up the picks and said track further including an arcuate section at the first side of said reed; a magazine disposed upstream of said arcuate section, as considered in the direction of travel of shuttles along said path; a supply of shuttles in said magazine; means for delivering successive shuttles from said magazine into said arcuate section; means for accelerating successive shuttles at least in the major part of said arcuate section so that the shuttles reach the first side of said reed and enter the shed while moving at a predetermined speed and thereupon return into said magazine; cooperating first and second guide means respectively provided on said reed and on said shuttles to maintain the shuttles in said path during travel through the shed, said first guide means comprising a comb having prongs extending between the warp threads; and means for moving said prongs out of the spaces between the warp threads in response to movement of said reed to beat up the picks.

19. The combination of claim 18, wherein said prongs together define a portion of said track for movement of the shuttles therealong during travel through the shed.

20. In a loom for weaving flat fabric, the combination of a track defining an endless path for gripper shuttles, said track including a reed having a first side for entry of shuttles into and a second side for exit of shuttles from the shed and said track further including an arcuate section at the first side of said reed; a magazine disposed upstream of said arcuate section, as considered in the direction of travel of shuttles along said path, and forming part of said track; a supply of shuttles in said magazine; means for delivering successive shuttles from said magazine into said arcuate section, including means for intercepting the shuttles arriving from the second side of said reed, said intercepting means being adjacent to said magazine, and means for propelling successive shuttles of said supply into the arcuate section of said track; means for accelerating successive shuttles at least in the major part of said arcuate section so that the shuttles reach the first side of said reed and enter the shed while moving at a predetermined speed and thereupon return into said magazine; and cooperating first and second guide means respectively provided on said reed and on said shuttles to maintain the shuttles in said path during travel through the shed.

* * * * *